United States Patent [19]

Christian

[11] 4,304,340

[45] Dec. 8, 1981

[54] SEMI-AUTOMATIC DISPLAY RELEASE MEANS FOR SINGLE COPY PERIODICAL VENDING MACHINES

[76] Inventor: Donald K. Christian, 119 Woodbine Ter., Spartanburg, S.C. 29301

[21] Appl. No.: 66,482

[22] Filed: Aug. 13, 1979

[51] Int. Cl.[3] ..... G07F 11/06

[52] U.S. Cl. ..... 221/90

[58] Field of Search ..... 221/90, 213, 230, 231, 221/232, 155

[56] References Cited

U.S. PATENT DOCUMENTS

| | | | |
|---|---|---|---|
| 2,816,688 | 12/1957 | Wolf | 221/90 X |
| 3,934,754 | 1/1976 | Dutro | 221/213 |
| 3,946,846 | 3/1976 | Pepiciello et al. | 221/90 |

*Primary Examiner*—Stanley H. Tollberg

[57] ABSTRACT

A semi-automatic display supporting mechanism for a single copy periodical vending machine wherein the display copy of a magazine, newspaper or the like is vended to a purchaser in due sequence after the principle storage area of the machine has been exhausted, which encompasses linkages whereby the supporting mechanism is reoriented to retain a new display copy by the very act of gaining access to the display area. The advantages are threefold in that the prospective purchaser may see a copy of that which he might purchase, the display copy is not wasted because it is vendable and because of the semi-automatic reset means a minimum of time is expended in replacing a vended copy.

6 Claims, 4 Drawing Figures

SEMI-AUTOMATIC DISPLAY RELEASE MEANS FOR SINGLE COPY PERIODICAL VENDING MACHINES

BACKGROUND OF THE INVENTION

In the newspaper and other periodical publishing industries it is desirable to place one or more copies of the publication for sale on display in the interest of inducing prospective purchasers to in fact become purchasers. This has customarily been provided for in vending machines of all types.

Many periodical vending machines have heretofore provided for displaying a copy of that which was for sale, some but not all provide for selling this display copy. U.S. Pat. Nos. 3,804,223 Voegeli and 2,904,216 Poland both teach this type of display. The former is addressed to the semi-honor type of vendor wherein the purchaser upon depositing the proper coinage has access to the total product content of the vendor and is trusted to take only one. It is intended that the last purchaser to gain access to the product storage area will remove the readily accessable display copy thus exposing an empty notation. The latter patent is addressed to the single copy vending art wherein the purchaser has access to only one copy for each insertion of proper coinage and wherein a means is provided to make the display copy available to the purchaser after the principal supply has been exhausted, again exposing some suitable lettering to indicate the machine is empty.

In both the above cited cases the access to the display area is in the back of the door and readily accessable to the service person who has access to the product storage or reloading chamber. In the former the display area has a fixed bottom and no action is required to ready it for reloading, the latter does require the closing of a display copy support means referred to as a trap door prior to insertion of a new display copy but this too is readily accessable to the service person.

The present invention is generally addressed to those single copy vendors wherein the access to the display area is outside the principle product storage area and not exposed to the service person in the course of reloading the principle storage area.

The present invention teaches the use of a linkage interconnected between the access door to the display area and the display copy support means whereby the opening of the access door resets said support means readying said display area for the insertion of a current display copy. A separate reset linkage could be provided but it would represent one more manual step in the reloading of the vendor and in many instances such as newspaper vending wherein a service person is required to refill a large number of vendors with a perishable product, any motion reducing innovation is of importance and when coupled with the means taught in the accompanying U.S. Patent Application Ser. Nos. 066,480, 066,481 for reducing the required service time, can make the heretofore generally financially impractical single copy vending, practical.

The present invention is not taught or suggested by the prior art which is exemplified by either the above mentioned or the following U.S. Pat. Nos. 3,174,608 Knickerbocker, 3,946,846 Pepiciello and 3,158,248 Hawks.

SUMMARY OF THE INVENTION

It is the object of the present invention to provide a unique means of resetting the support means contained within the display area of a single copy periodical vending machine thus reducing the number of manual operations required in the servicing of the same. It is further the object of this invention to teach the mounting of a vend-ready storage means and a display means in the same door assembly thus making said storage means readily accessable when the door assembly is pivoted out from a hinged vending machine housing, thus saving more time.

Generally speaking the present invention relates to a vending machine for dispensing a single copy of a periodical with each proper insertion of coinage and, containing a display area not generally accessable from the principal reloading area. It provides a means for supporting a display copy within an enclosure which is operatively interconnected so as to actuate said support means whenever the access door to said display enclosure is opened.

More specifically the preferred embodiment of the present invention is contained within a drop shelf newspaper vending machine comprised of a sheet metal housing to which is hinged a lock containing door assembly and wherein all the working parts of the machine are contained within the door assembly of said machine. A display means comprised of a housing, a window, a back plate, a display copy support means and a latchable hinged closure is afixed to the outside of the door and a drop shelf magazine for containing the vend ready newspapers is afixed to the back of the door. Also contained within the door is a conventional coin mechanism and linkage assembly which can be any of a number known to those skilled in the trade such as a reciprocating coin acceptor operatively linked to a manually releasable ratchet assembly as aptly described in U.S. Pat. No. 3,946,846, a rotatable knob coin mechanism as in U.S. Pat. No. 2,361,977 Stair or a coin connected actuating lever/rotatable shaft arraingement as in U.S. Pat. No. 2,753,033 Fancher. The function of said coin acceptor is to index a drive shaft mounted sprocket. Suspended between the drive shaft sprocket and an idler sprocket assembly is a roller chain bearing two actuators one of which sequentially removes the support from the leading edges of the shelves contained within the drop shelf magazine, said action causing same to fall releasing their contents through appropriate guides and chutes to a vend delivery area accessable to the purchaser. Upon the coin acceptor actuation subsequent to the dropping of the last shelf, the other of the two chain borne actuators mentioned above lifts a latch interconnected to the display area support means causing same to drop from their position of support thus releasing the display paper directly into a vend delivery area accessible to the purchaser. The back plate of the display area bearing the words "sold out" is now exposed to any potential purchaser.

A service person upon unlocking the door assembly may swing it outwardly in such manner that the drop shelf magazine is readily accessable for loading. A release means is provided within the door for loosing the latch which secures the display area hinged closure. As this closure is opened to permit the insertion of a current display copy, an appropriate interconnected linkage reestablishes the display copy support means in its mode of support. A display copy is inserted, released and the closure returned to its latched position. Upon loading of the drop shelf magazine the door assembly is swung back into its housing and the door locked thus being readied for use.

A BRIEF DESCRIPTION OF THE DRAWINGS

DESCRIPTION OF THE PREFERRED EMBODIMENTS

The preferred embodiments of the present invention will now be specifically described making reference to the Figures.

Figure 2:
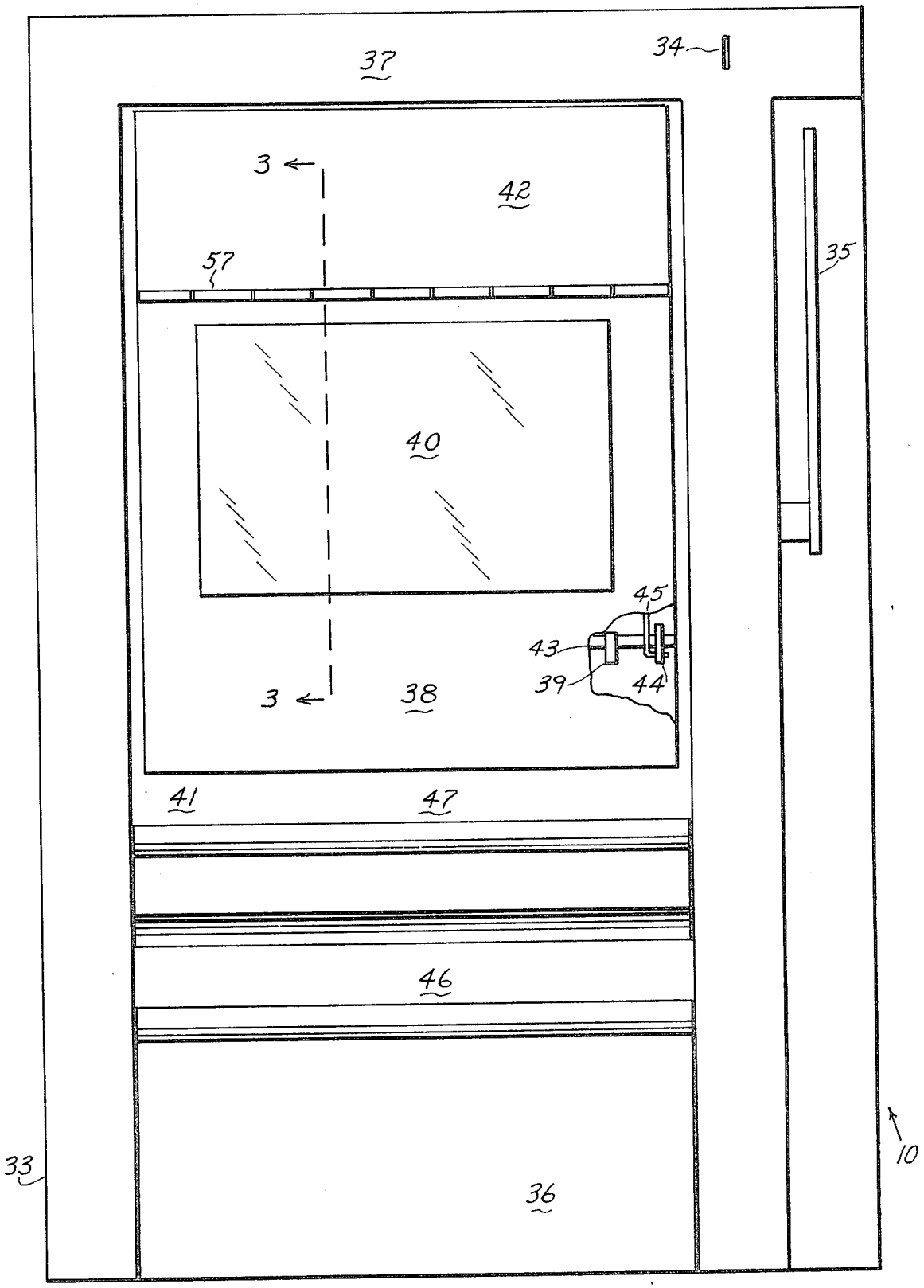
FIG. 2 is a front view of the door assembly.

In FIG. 2 a vending machine door assembly generally indicated as 10 is shown to include housing 33, coin slot 34, actuating lever 35, lower panel 36, top panel 37, display area housing 38, support fingers 39, window 40, back plate 41, hinged closure 42, support finger shaft 43, lower shaft arm 44, support rod 45 and purchaser access areas 46 and 47.

Figure 1:
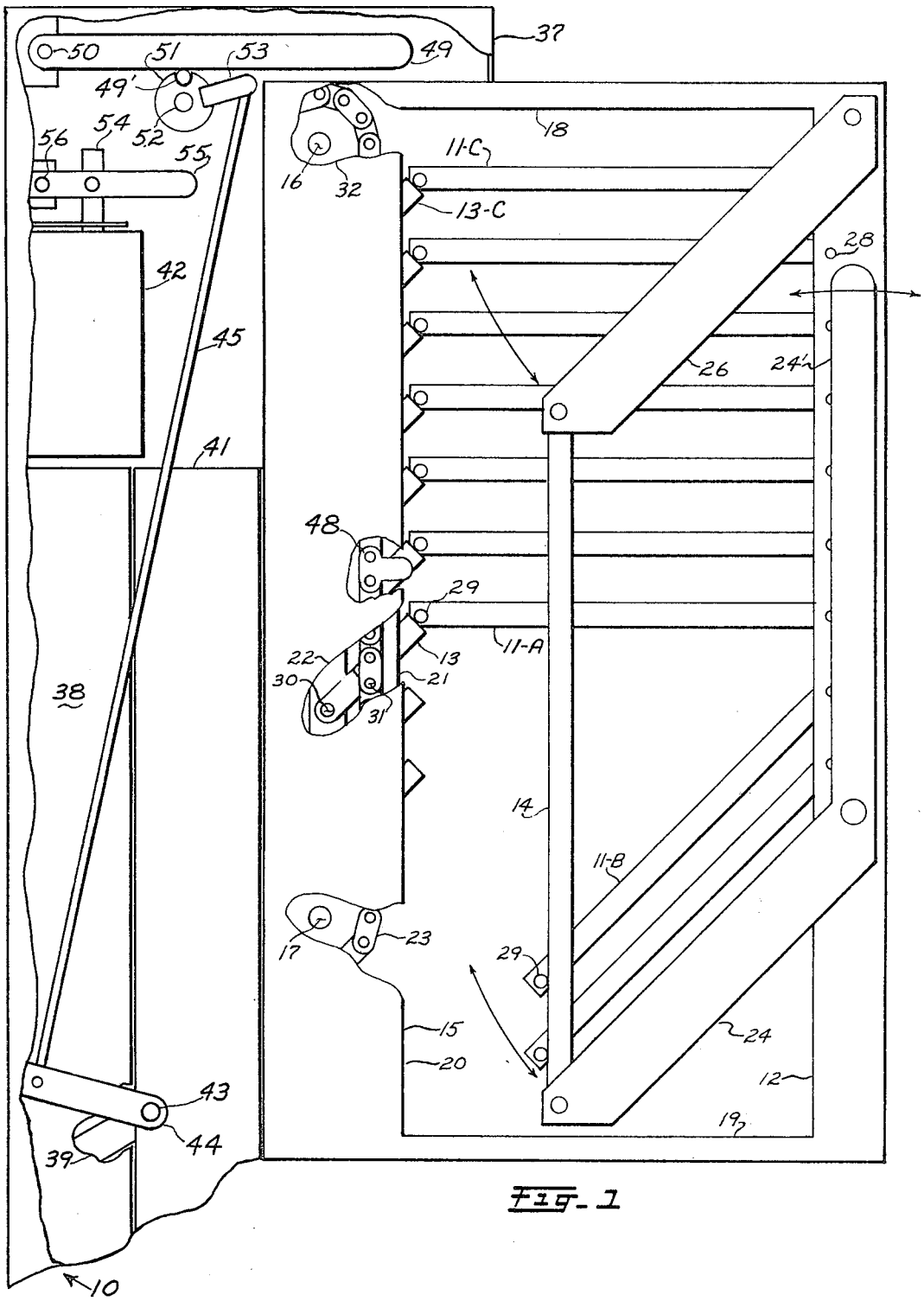
FIG. 1 is a cut away side view of a vending machine door assembly.

FIG. 1, unitary structure 20 comprised of vertical members 12 and 15 and horizontal members 18 and 19, contains shelves 11, shelf resetting members 14, 24 and 26, pawls 13, pawl mounting block 22, pawl pivot pin 30, chain guide 21, actuating pin 31, drive shaft 16, sprocket 32, chain 23 and idler assembly 17, and is fixed to the back of door assembly 10 providing a product storage area. Upon the proper insertion of coinage, actuating lever 35 thru a conventional ratcheting arrangement such as described in U.S. Pat. No. 2,361,977 causes driveshaft 16 and sprocket 32, fixed thereto, to index in a counter-clockwise manner causing roller chain 23 and its associated actuating pin 31 to move generally upward a predetermined distance, said actuating pin wedging itself between chain guide 21 and a lip contained on pawl 13. (U.S. Pat. Application Ser. No. 066,480 Christian which accompanies this application fully expounds this function). Said pawl thus rotates in a counter-clockwise manner pivotally about pawl pin 30 thus removing itself from its position of support under shelf 11-A. Having been thus deprived of its forward support, front of shelf rotates downwardly about pivot point 28 dropping its contents thru appropriate guides and chutes, not shown, to purchaser access area 46. Dependent upon proper insertion of coinage in coin slot 34 and cycling of actuating lever 35, the shelves are dropped sequentially in like manner until uppermost shelf 11-C is dropped thus exhausting the products contained within the product storage area.

Yet another cycle of said actuating lever 35 brings dog 48, which is associated with chain 23, in contact with support lever 49 causing it to rotate upwardly about pivot pin 50 thus releasing rod 49' from its position of engagement with restraining cam 51. Thus released, cam 51 frees upper shaft 52 upper shaft arm 53, both of which are affixed to cam 51, to rotate downwardly. Upper shaft 52 and support finger shaft 43 are summarily supported by housing 33 and free to rotate therein. Support rod 45, being pivotally mounted to upper shaft arm 53 and lower shaft arm 44, releases support finger shaft 43 which is in turn fixed to both support fingers and lower shaft arm 44, permitting counter-clockwise rotation thereof and thereby removal of support fingers 39 from their position of support. Content of display area, not shown, is so released to purchaser access area 47.

When machine is to be reloaded door assembly is unlocked and swung away on vertical hinge 61. Drive shaft 16 is rotated manually in a counter-clockwise manner until actuating pin 31 reaches a predetermined point underneath the lowermost pawl 13. Shelf reset handle 24' is pulled back actuating resetting members 14, 24 and 26 until shelves are generally horizontal and shelf pawls 13 have positioned themselves under shelf rods 29. Shelf reset handle is then returned to its position of rest as shown and the machine is ready for reloading.

Latch 54, loosely mounted in top panel 37 is manually raised by upward force on handle 55 interacting with said latch and pivot pin 56. Hinged closure 42 is pivoted outwardly arround hinge 57.

Figure 3:
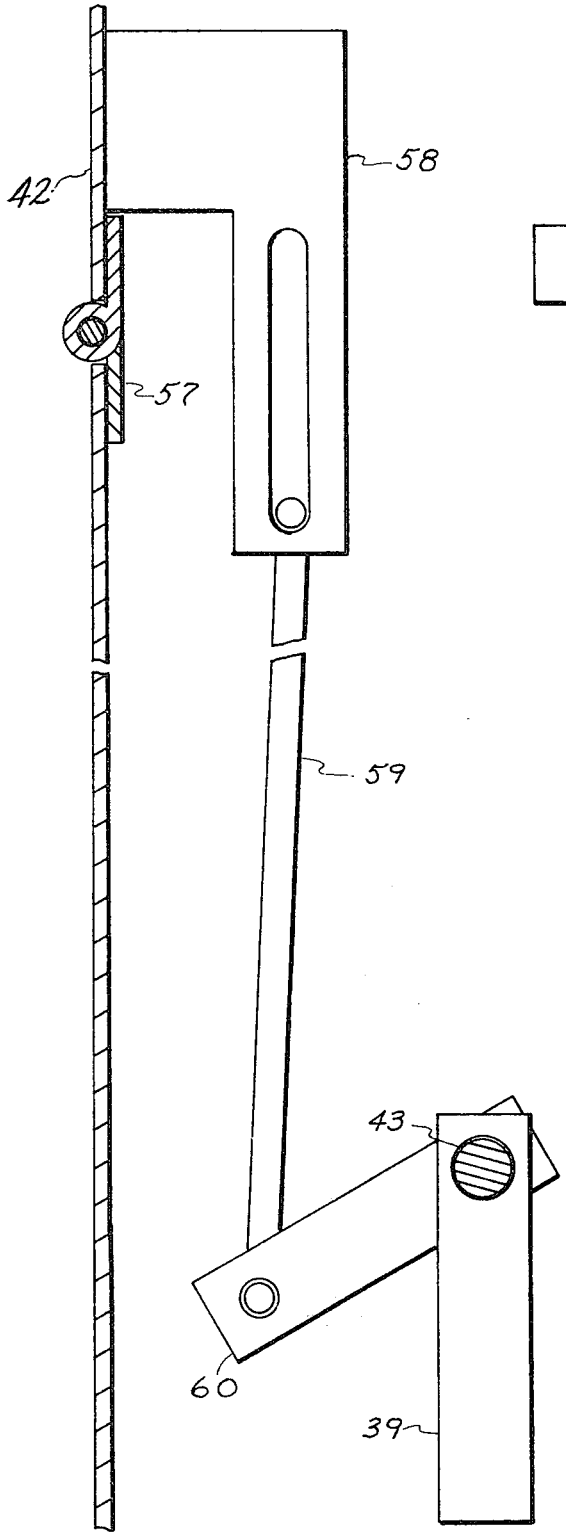
FIG. 3 is a cut away view of the reset linkage.
Figure 4:
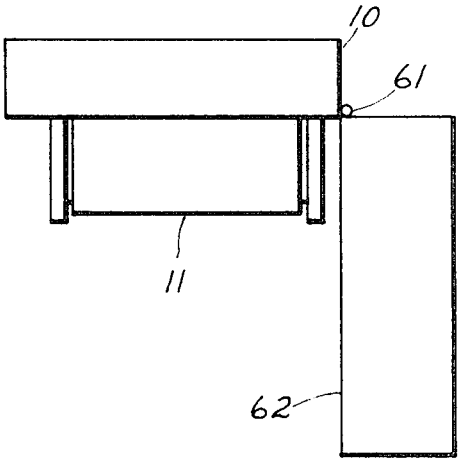
FIG. 4 is a top view of a door assembly pivoted out of its housing for service.

In reference to FIGS. 1 and 3, as hinged closure 42 pivots outwardly, upper reset arm 58, being fixed to said hinged closure and associated with pivotally mounted reset rod 59, exerts a generally upward force against lower reset arm 60 precipitating a clockwise rotation of support finger shaft 43 which in turn raises lower shaft arm 44, support rod 45 and upper shaft arm 53 causing upper shaft 52 and restraining cam 51 to rotate in a counter-clockwise manner. As rod 49' is aligned with the slot in said restraining cam, support lever 49 rotates downwardly engaging rod 49' in said restraining cam slot thus interconnectly aligning support fingers 39 to receive a display copy. A display copy is inserted through hinged closure opening and hinged closure 42 is closed. Latch 54 engages in a slot provided therefore in said hinged closure, the door assembly 10, pivoting about vertical hinge 61 is inserted into machine enclosure 62 and lock, not shown, is secured thus readying machine for its intended purpose of merchandising.

Having described the present invention in detail, it is obvious that one skilled in the art will be able to make modifications and variations thereto without departing from the scope of the present invention. Accordingly, the scope of the present invention should be determined by the claims appended hereto.

What is claimed is:

1. A novel display release means for single copy periodical vending machines wherein is provided:

(a) a support means within a functionally transparent enclosure to support a display copy of the periodical for sale in such manner that at least a portion of said copy may be viewed by a prospective purchaser (b) a pivoted access covering for enclosing the area wherein a display copy maybe inserted (c) a linkage to release or remove said support means at some predetermined time (d) an associated linkage connected to said support and moving it to periodical support position upon opening of said pivoted access covering.

2. A display means as described in claim 1 wherein the support means may be reset or restored by the opening of the principal access closure of a periodical vending machine.

3. A display means as described in claim 1 wherein the support means may be reset or restored by interconnection with a shelf resetting means.

4. A display means as described in claim 1 wherein the periodical is a newspaper.

5. A display means as described in claim 1 wherein the periodical is a magazine.

6. A display means as described in claim 1 wherein a multiplicity of which are contained within a single vending machine housing.

* * * * *